US005234331A

United States Patent [19]

Schmidgall

[11] Patent Number: 5,234,331

[45] Date of Patent: Aug. 10, 1993

[54] AUTOMATED PIPE MAKING MACHINE

[75] Inventor: Ronald D. Schmidgall, Des Moines County, Iowa

[73] Assignee: Hawkeye Concrete Products Co., Mediapolis, Iowa

[21] Appl. No.: 729,476

[22] Filed: Jul. 12, 1991

[51] Int. Cl.[5] ..... B28B 21/24; B28B 13/02

[52] U.S. Cl. ..... 425/259; 425/261; 425/453

[58] Field of Search ..... 425/453, 258, 26 R, 425/DIG. 201, 145, 256, 259, 261; 222/305, 306

[56] References Cited

U.S. PATENT DOCUMENTS 3,577,610 5/1971 Margolin ..... 425/259
3,970,223 7/1976 Longinotti ..... 425/258
4,063,859 12/1977 Halle et al. ..... 425/259
4,102,367 7/1978 Shulman et al. ..... 425/258
4,321,028 3/1982 Van de Caveye ..... 425/424
4,708,621 11/1987 Schmidgall et al. ..... 425/259
4,957,424 9/1990 Mitchell et al. ..... 425/424
5,040,968 8/1991 Kraiss ..... 425/262

*Primary Examiner*—Khanh P. Nguyen
*Attorney, Agent, or Firm*—James C. Nemmers

[57] ABSTRACT

An automated concrete pipe making machine that utilizes an automatic feeding system in which a feed tray and its feed pan are mounted on a carrier that moves from a retracted position into a feeding position where the feed tray is aligned with and locked to the pan at the top of the form or forms to be filled. At the appropriate time after the forms have been filled, the feed pan is withdrawn onto the feed tray, which is then unlocked from the top of the form and retracted.

8 Claims, 9 Drawing Sheets

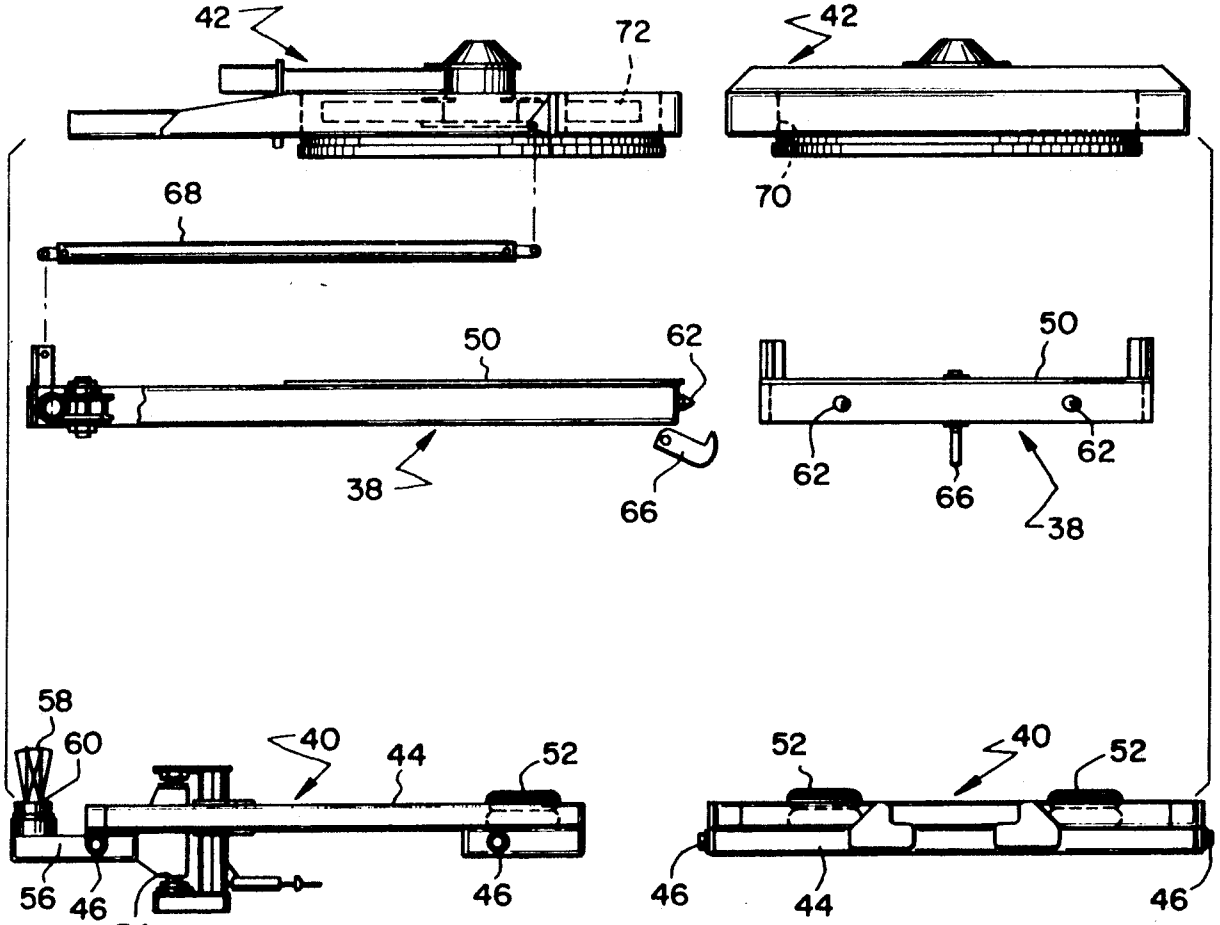
FIG. 5
FIG 4
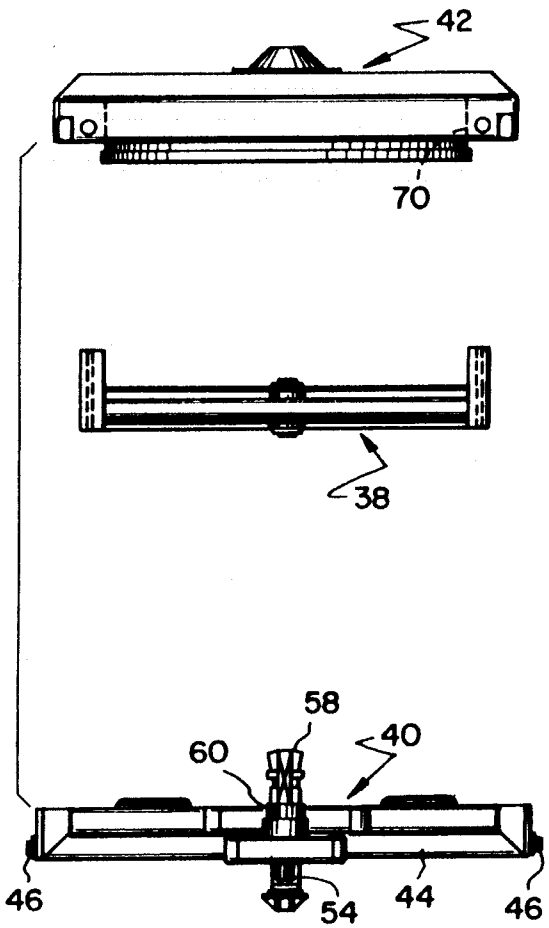
FIG. 6

AUTOMATED PIPE MAKING MACHINE

BACKGROUND OF THE INVENTION

This relates to machines for producing concrete products such as concrete pipe, manholes, catch basins and the like. Such machines are used to produce pipe in a dry cast operation which involves the three basic steps of filling the forms, pressureheading the concrete in the forms and then stripping the forms from the pipe and allowing them to cure. As is well known, the three basic operations are performed simultaneously at three separate stations, and three form sets are mounted at equally spaced stations on a turntable that is controllably rotated so that each of the operations can be performed on each form set as it is rotated into the filling, pressureheading and stripping stations. In this manner, the three-station turntable allows three different pipe sizes or types to be produced side by side in a single cycle of operations that occurs during one complete rotation of the turntable. An example of a machine of this type is shown in U.S. Pat. No. 4,708,621 which shows a machine capable of producing multiple forms at a single station of the turntable.

At the present time, each of the dry cast operations are performed manually by operators which operate controls to fill the forms, pressurehead them and then strip them. This usually requires three men, one to control the basic turntable operation, a crane operator, and a third man who cleans, oils and loads the headers at the pressureheading station. Although machines of this type are quite efficient, they do require considerable manpower and training to produce quality concrete products. Automation of machines of this type would increase the efficiency of the operation, provide more consistent quality of the finished product and lessen the manpower and physical labor involved in producing concrete products of this type. However, with machines of this type, the pipe forms are anchored only at the bottom on the turntable to provide for faster changeover from one form set to a different form set. Moreover, since operating conditions in concrete pipe plants are not always perfect nor consistent from plant to plant, any automated machine must be capable of self-alignment between the form sets and the operating components and must also be capable of overcoming known imperfections and inconsistencies in plant operations.

There is therefore a need for an automated pipe making machine that can achieve a high level of production output while still permitting versatility and flexibility to allow quick and easy changeover from one form type or size to another.

There is also a need for an automated pipe making machine that is simple to operate and requires a minimum of operator training, and yet one that will work dependably in a variable and imperfect pipe plant environment.

In order to achieve these objectives, such a machine must provide an automated feeding system and a flexible and versatile pressureheading system to accommodate various pipe sizes and types that might be run side by side on the same turntable.

SUMMARY OF THE INVENTION

The automated pipe making machine of the invention utilizes an automatic feeding system in which a feed tray and its feed pan are mounted on a carrier that moves from a retracted position into a feeding position where the feed tray is aligned with and locked to the pan at the top of the form or forms to be filled. In a machine of the pressureheading type, the forms are secured to the base of the turntable, and when an empty form is moved into position in the feeding station, the feed tray is advanced and locked to the form. The feed pan is then advanced onto the top of the form pan, and the concrete is fed into the pan while a rotor distributes the concrete into the forms. At the appropriate time after the forms have been filled, the feed pan is withdrawn onto the feed tray, which is then unlocked from the tray at the top of the form and retracted by the carrier. By a unique mounting of the feed tray on its carrier, the feed tray is free to move in any direction, and by the use of guide pins on the feed tray that enter corresponding guide openings on the tray at the top of the form, proper alignment will be assured.

The automated machine of the invention also automates the operations at the pressureheading station. To accomplish this, the pressureheading station includes a carousel that revolves three pressurehead assemblies mounted on an adjustable frame and each carrying a standardization or mounting ring to which there can be attached different header clamping fixtures depending upon the number and size of the forms at each turntable station. In other words, the mounting ring allows the same basic assembly to be used to carry a header clamping fixture for a single pipe form or for multiple forms as well. At the header loading station, headers are loaded onto a cart in predetermined positions determined by guide pins on the cart. The top of the cart upon which the headers are placed is mounted on coil springs so that it is free to adjust to any minor variation in the alignment of the pressurehead assembly. The header clamping fixture also contains an alignment pin that corresponds to an alignment opening on the header cart to assure proper pick-up and positioning of the headers within the header clamping fixture assembly. After the headers are picked up by the header clamping fixture, the headers are moved to a dip tank during the next revolution of the carousel, where the headers are dipped into a solution of a concrete releasing agent. The next revolution of the carousel will move the assembly carrying the headers into the pressureheading station where the headers are lowered onto the tops of the forms and then pressed into the filled pipe forms, after which the clamping fixture is released from the headers and withdrawn. Thus, while one assembly of the pressureheading carousel is performing the pressureheading operation, a second assembly, which has already picked up headers, dips the headers into a bath containing a concrete release agent, such as oil. Simultaneously, the third assembly is picking up the headers from the header cart to await movement to the oil bath and then to the pressureheading station as the turntable rotates.

Thus, by using novel techniques that provide for proper alignment of the automated components, the filling and pressureheading operations can be performed quicker and with less manpower, resulting in a product more consistently high in quality and lower in cost.

BRIEF DESCRIPTION OF THE DRAWINGS

FIG. 4 is a side elevational view of the feed tray and its carrier with the components separated for purpose of clarity;

FIG. 5 is a front elevational view of the feed tray and its carrier with the components separated for purpose of clarity;

FIG. 6 is a rear elevational view of the feed tray and its carrier with the components separated for purpose of clarity;

DESCRIPTION OF THE PREFERRED EMBODIMENT OF THE INVENTION

Figure 1:
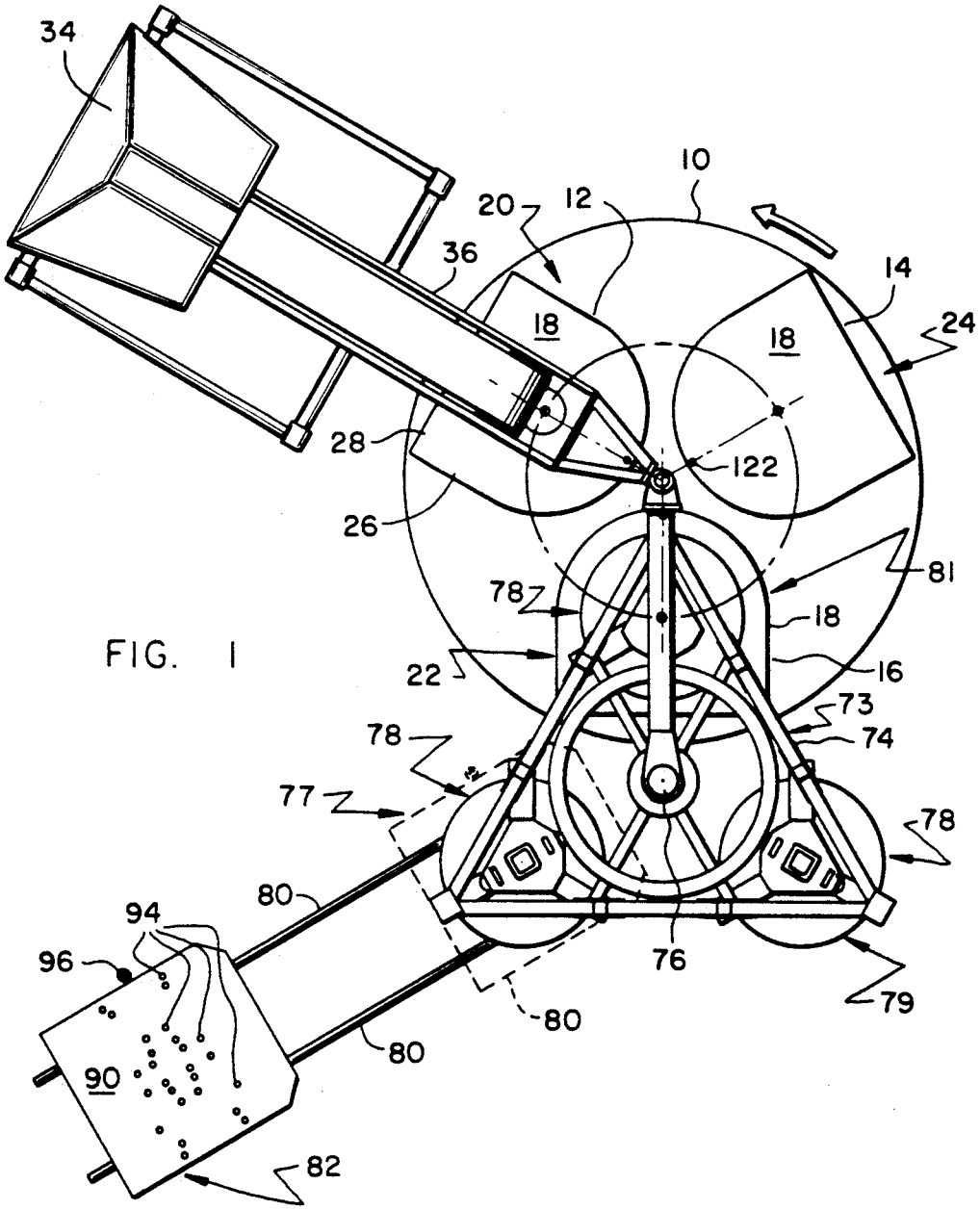
FIG. 1 is a top or plan view showing schematically the operating stations and turntable constructed to utilize the principles of the invention.

Referring first to FIG. 1, there is illustrated a concrete pipe making machine constructed according the principles of the invention which includes a turntable 10 having three equally spaced apart work stations 12, 14 and 16 in each of which there is positioned a form set 18 which may contain a single form for making a single product, such as a concrete pipe, or multiple forms for making two or more pipes simultaneously. The turntable 10 is mounted in a pit 15 (see FIGS. 2 and 3) beneath the level of the floor 17, and the form sets 18 are anchored at their lower ends to the turntable 10 using two anchor pins (not shown) in a manner that is well known to those skilled in the art. Since the forms sets 18 are anchored only at their lower ends to the turntable 10, the form sets 18 will not stay precisely centered or in any fixed position. However, the form sets 18 are attached to the turntable in this manner to permit easy and fast changeover from one form set to a different form set. An illustration of a machine of this general type is shown in U.S. Pat. No. 4,708,621.

As is well known to those skilled in the art, the turntable 10 is rotated to bring each of the stations 12, 14 and 16 sequentially into the three operating stations, the filling station 20, the pressureheading station 22, and the stripping station 24. Thus, with form sets 18 properly installed at each of the working stations 12, 14 and 16 of the turntable 10, each form set 18 will be sequentially filled with concrete at the filling station 20, a header applied to the top of each pipe form at the pressureheading station 22, and the forms stripped from the pipes at the stripping station 24. As is well known, the formed pipes are then transported to an area where the concrete is allowed to cure.

Figure 2:
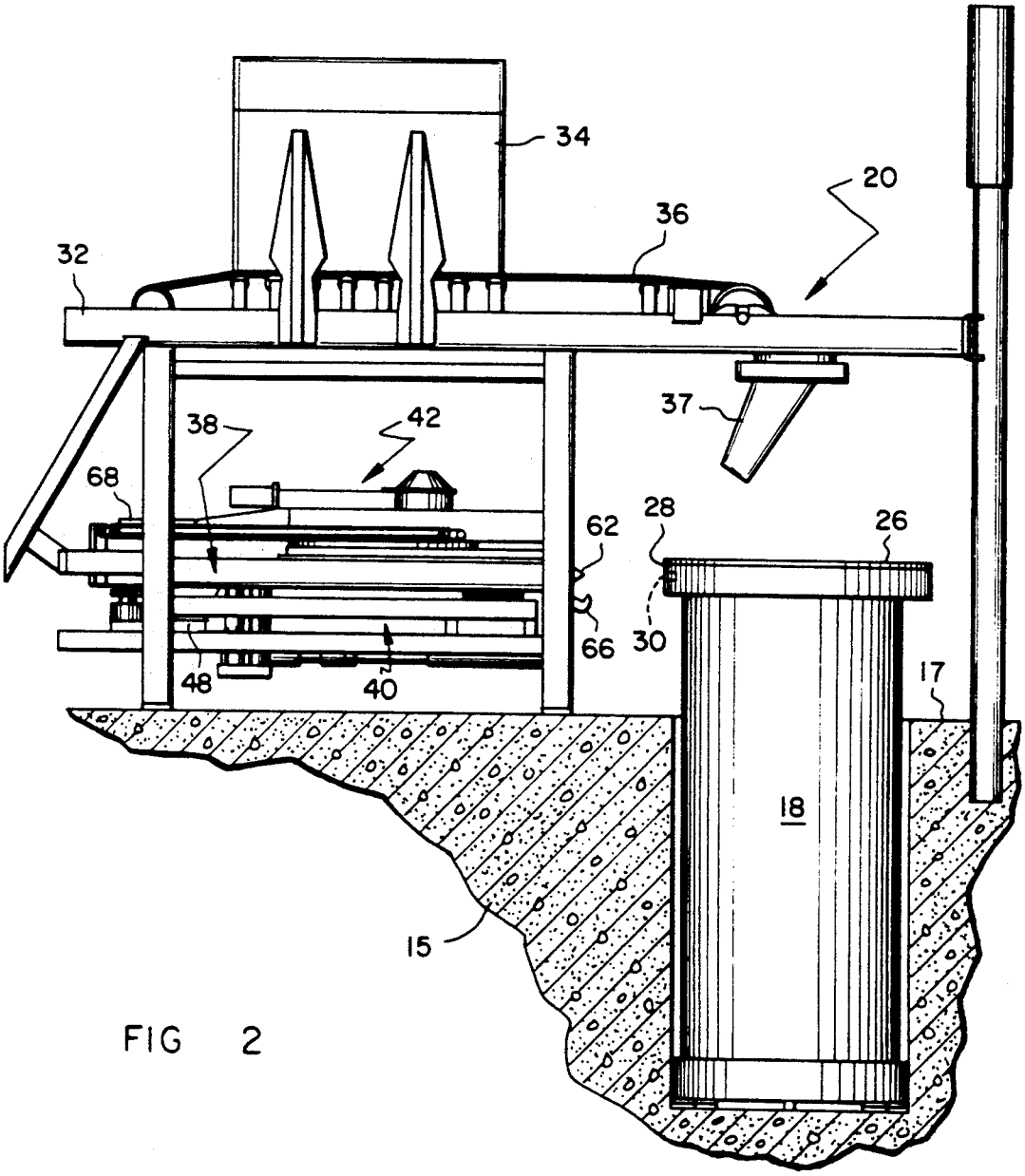
FIG. 2 is a side elevational view showing schematically the automated feeding station with the feed tray retracted.
Figure 3:
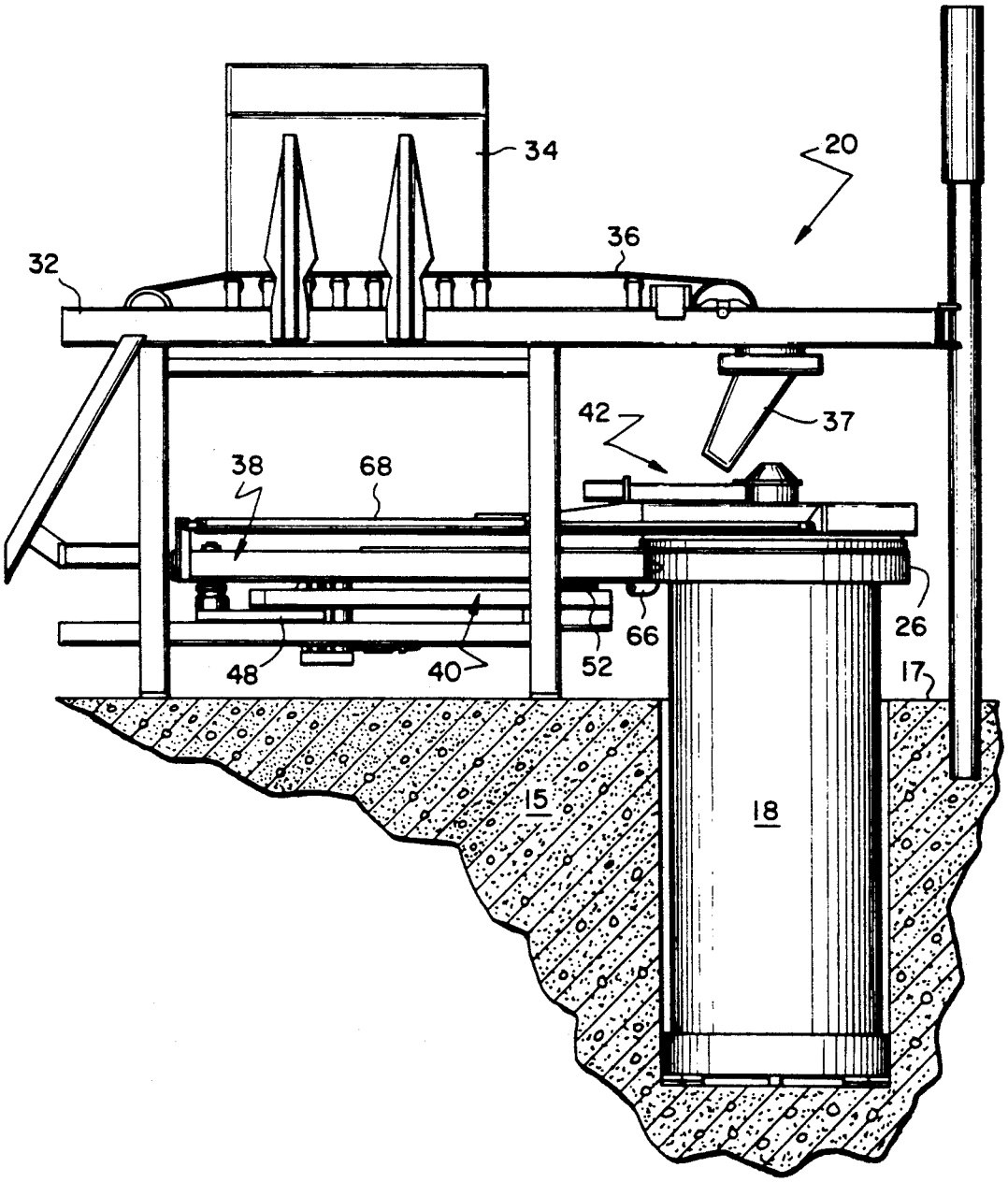
FIG. 3 is a side elevational view showing schematically the automated feeding station with the feed tray in feeding position.

At the filling station 20, the forms are filled quickly and automatically using the principles of the invention. FIGS. 2–5 illustrate generally the automated filling station. Each form set 18 has a top pan 26 that provides a flat smooth upper surface. One edge 28 of the top pan 26 is oriented toward the outside of the turntable 10 generally along a chordal line of the circular turntable 10. The size, shape and dimensions of the top pan 26 are the same regardless of whether a single large pipe, multiple pipes in a single form set 18, or an elliptical pipe is being produced. Thus, the invention can be utilized for any size or shape of pipe or for multiple pipes in a form set 18, and can be utilized even if different size or shape or combinations of pipe are being simultaneously run on the work stations 12, 14 and 16. As is indicated in FIGS. 2 and 3, the outer edge 28 of pan 26 has formed in it a pair of alignment holes 30 the purpose for which will be evident from the description hereinafter.

At the filling station 20, a main frame 32 supports a hopper 34 beneath which runs a conveyor 36 that when operable will move concrete from the hopper 34 toward a chute 37 supported above the top of pan 26. Beneath the hopper 34 there is mounted a feeder tray, indicated generally by the reference numeral 38, that is supported for limited movement in all directions on a feeder carrier indicated generally by the reference numeral 40. The feeder tray 38 supports and carries with it an independently moveable feeder pan indicated generally by the reference numeral 42. The relationship of these components when retracted are illustrated in FIG. 2 while FIG. 3 shows the feeder pan 42 extended over the top of pan 26.

As best seen in FIGS. 4, 5 and 6, the feeder carrier 40 has a main frame 44 to which there are attached wheels 46 that run along tracks 48 that therefore provide for movement of the carrier 40 inwardly and outwardly toward and away from the turntable 10. The feeder tray 38 has a generally flat upper surface 50 at the forward end, and the forward end is supported on either coil springs or airbags 52 which are supported by the frame 44 of the feeder carrier 40. At the rear, the feeder tray 38 is connected to the feeder carrier 40 through an arrangement that allows the feeder tray to be free to move in any direction. To provide for this free movement, the frame 44 of the carrier 40 has a vertical pivot pin 54 about which pivots a rearwardly extending arm 56. The outer end of arm 56 is in turn connected to the rear of the feeder tray 38 by a vertical pivot pin 58 pivotly connected to the tray 38, and which pin 58 is connected to the arm 56 of the carrier 40 through a universal joint 60. Thus, with this jib and U-joint arrangement, the feeder tray 38 "floats" so that it can move or gimbel in any direction. This freedom of movement allows the feeder tray 38 to adjust so that it can be properly and accurately aligned with the top of the pan 26 of a form set 18. It will be understood that once the form set 18 is properly installed, it is not moveable; however, being anchored only at the bottom to the turntable 10, the form set 18 "rocks". Therefore, to assure a positive and accurate alignment of the feeder tray 38 with the top pan 26 of a form set 18, the front edge of the feeder pan 38 is provided with tapered alignment pins 62 which are engageable with the holes 30 in the top pan 26.

The feeder carrier 40 is advanced along the tracks 48 by the operation of suitable power means such as a hydraulic cylinder (not shown). The feeder carrier 40 is advanced until the front edge of the feeder tray 38 is very close to the outer edge 28 of the top pan 26 of a form set 18. At this time, advancement of the feeder tray 38 is stopped, and a hook 66 mounted on the front edge of the feeder tray 38 engages beneath the outer edge 28 of the top pan 26 to lock the feeder tray 38 positively to the top pan 26 and hold it in place during the filling operation.

Referring now to FIGS. 4, 5 and 6, there is illustrated a feeder pan 42 which is carried by the feeder tray 38, and when withdrawn rests on the flat upper surface 50 of the feeder tray 38. The feeder pan 42 is connected along each side to a pair of hydraulic cylinders 68 which are connected to vertical supports 69 secured to the feeder tray 38. The feeder pan 42 has a circular inner wall 70 that provides the walls of a chamber into which the concrete is discharged from the hopper conveyor 36. A rotor 72 provides for distribution of the concrete evenly into the forms of a form set 18 when the feeder pan 42 is positioned over the top pan 26. Thus, after the feeder tray 38 is advanced by the feeder carrier 40, and after the feeder tray 38 is locked onto the top pan 26, the hydraulic cylinders 68 are actuated to advance the feeder pan 42 over the top of the top pan 26 of a form set 18. With the rotor 72 operating, concrete is fed from the hopper 34 onto conveyor 36 which discharges the concrete into chute 37 that guides the concrete into the feeder pan 42. As is well known, when the forms are filled, sensors (not shown) will shut off the conveyor 36 and rotor 72 and actuate hydraulic cylinders 68 to start withdrawal of the feeder pan 42 from the top pan 26. Withdrawal of feeder pan 42 scrapes the top surface of the top pan 26 as the feeder pan 42 slides back to the top of the feeder tray 38, any excess concrete remaining in the feeder pan 42. Once the feeder pan 42 has been fully retracted onto the top surface 50 of the feeder tray 38, the feeder carrier 40 returns back home to its original position.

The filling operation for a first station 12 having been completed, the turntable will rotate 120 degrees to advance station 12 to the pressureheading station 22 while station 16 is moved to the stripping station 24 and station 14 is moved into the filling station 20 ready for the filling cycle to be commenced as just described.

At the pressureheading station 22, headers 75 (see FIG. 9) are applied to the top of each form. As is well known, headers are metal rings forced by pressure into the top of the wet concrete in the pipe form to form the male end of the pipe and to assure that the male end stays round so that when the pipe is connected to a like section of pipe, a proper and tight joint will be formed that will not leak. At the present time, headers are manually dipped into a bath containing a concrete releasing agent and placed on top of each form, and then a pressureheading assembly is lowered to force the header into the top of the wet concrete. These operations require three independent steps and require the full time attention of a single skilled worker, who must be trained to properly position the headers on top of the forms before pressure is applied by the pressureheading assembly. As previously indicated, and as illustrated schematically in FIG. 1, the invention utilizes a carousel type arrangement at the pressurehead station 22 to carry out the three operations. A carousel, indicated generally by the reference numeral 73, is mounted on a carousel frame 74 that is supported on a vertical column 76. A hydraulically-powered wheel (not shown) or other suitable power means rotates the carousel 73. The carousel frame 74 supports three equally spaced pressureheading assemblies, each indicated generally by the reference numeral 78, that are moveable into three separate stations as the carousel 73 rotates. At the first station, the header loading station 77, the headers 75 are picked up by one of the assemblies 78. At the next station, the dipping station 79, the headers 75 are dipped into a bath of a concrete releasing agent. At the last station, the pressureheading station 22, the headers 75 are pressed into the top of the form cavity containing the wet concrete.

Figure 12:
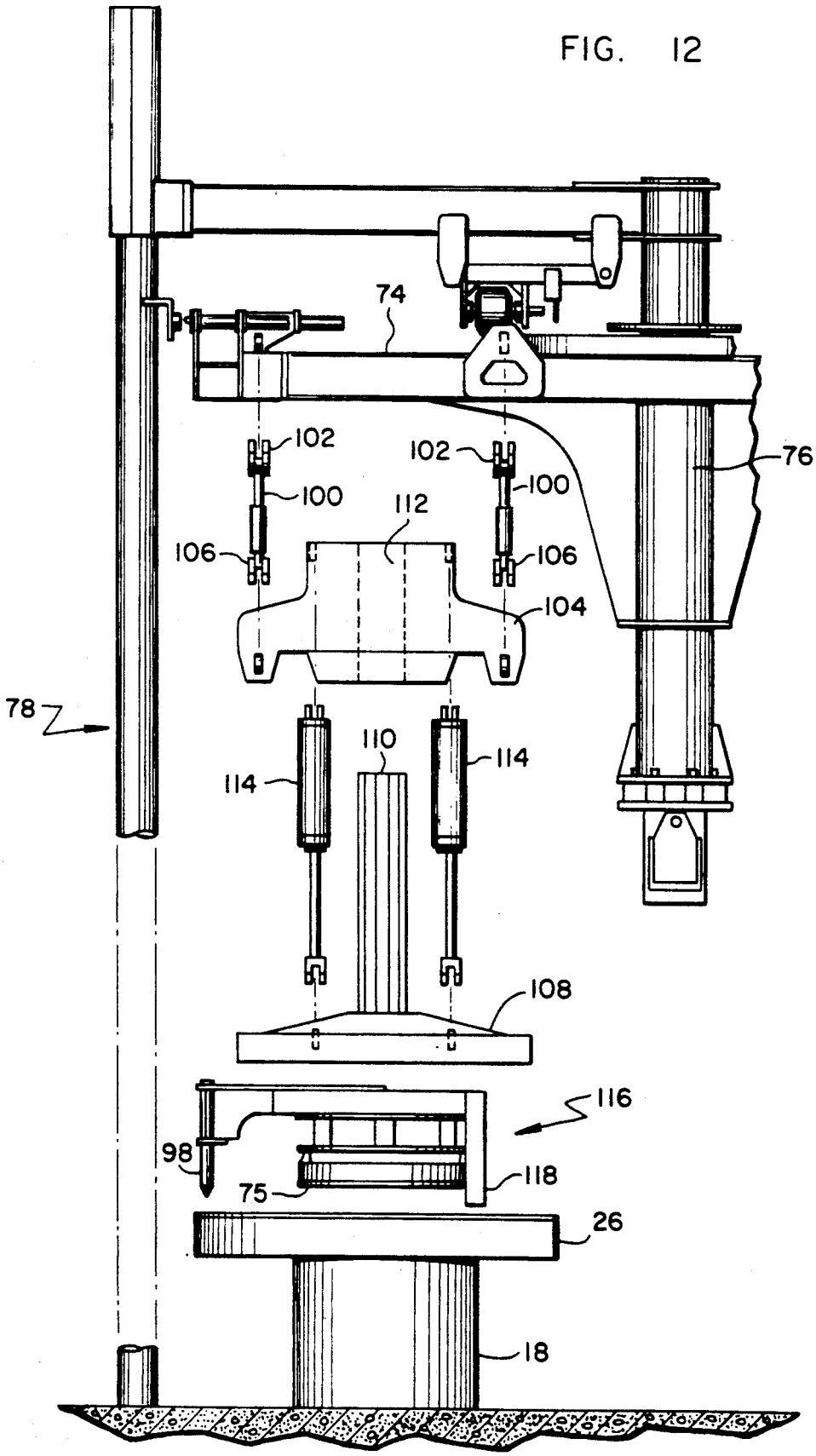
FIG. 12 is an exploded side elevational view of the pressure head clamping assembly and showing its mounting to the carousel.

As best seen in FIG. 12, which is an exploded view of a pressureheading assembly 78, an arm of the carousel frame 74 supports the pressureheading assembly 78 through turn buckles 100 which are suspended from the frame 74. The upper ends of the turn buckles 100 are attached by pivot blocks 102 to the carousel frame 74 while the lower ends of the turn buckles 100 are attached to the basic pressurehead cartridge 104 through pivot blocks 106. This structure is required because, as previously noted, the form sets 18 are attached to the turn table 10 at their lower ends, and therefore the form sets 18 can "float" or "rock" slightly. It is therefore necessary for the pressureheading assemblies 78 to self-align with the form sets 18. The turn buckles 100 not only permit the cartridge 104 to "float", but the length of each turn buckle 100 can be adjusted so that the cartridge 104 can be squared-up to the top pan 26 of the form set 18.

A mounting ring 108 is operatively connected to the cartridge 104 by a central vertical support 110 that it attached to the ring 108 and slides upwardly and downwardly through an opening 112 in the cartridge 104. Movement of the mounting ring 108 is controlled by a pair of air cylinders 114 operatively attached to the cartridge 104 and the mounting ring 108 as shown in FIG. 12.

The mounting ring 108 has attached to it a pressurehead clamping fixture indicated generally by the reference numeral 116. The mounting ring 108 is adapted to receive a particular pressurehead clamping fixture 116 for the particular form set 18 that is being filled. In other words, if a single pipe form is contained in the form set 18, the pressurehead clamping fixture for that particular size of pipe will be used. However, if two or more pipe forms are contained in a form set 18, the clamping fixture 116 will be the clamping fixture for that particular set of pipe forms. For purposes of simplicity and clarity, the clamping fixture 116 shown in the drawings is for a single pipe. Preferably, the clamping fixture 116 is bolted to the mounting ring 108 so that the clamping fixtures 116 can be quickly and easily interchanged for different form sets. After the clamping fixture 116 is bolted to the mounting ring 108, it will of course travel upwardly and downwardly under control of the air cylinders 114.

Each clamping fixture 116 has a plurality of clamps 117 that will swing outwardly to grip the header 75. Regardless of the number or size of headers 75 that it is designed to handle, each clamping fixture 116 also is equipped with two side arms 118 and the alignment pin 98.

At the loading station 77, and depending upon the particular plant layout, a pair of tracks 80 are installed so as to run beneath the outermost arch of the carousel frame 74. Tracks 80 carry a header cart indicated generally by the reference numeral 82 and shown in FIGS. 9 and 10. Header cart 82 has a main frame 84 to which wheels 86 are connected and which wheels 86 engage with the tracks 80 to provide for advancement of the cart from a loading area to a position beneath the carousel frame 74. The wheels are powered by a suitable hydraulic motor (not shown) or other suitable power means. The table top 90 of the cart 82 is supported on the main frame 84 through a cluster of coil springs 92 at each corner. The table top 90 also contains a plurality of pins 94 projecting from the top surface of table 90, the pins 94 being used to position different sizes and numbers of headers 75 depending upon the particular form set 18 that is to be pressureheaded. Pins 94 may be mounted so that they can be raised or lowered either manually or otherwise. The mounting of the table top 90 on the frame 84 allows the table top 90 to be self-aligning, and to assure proper alignment, the table top 90 contains a vertical hole 96 (FIG. 1) along one edge for engagement with the alignment pin 98 on the pressureheading assembly 78. Also, because the basic cartridge 104 and mounting ring 108 float, proper alignment of the pressureheading assembly 78 with a header 75 on the header cart 82 is assured.

Figure 9:
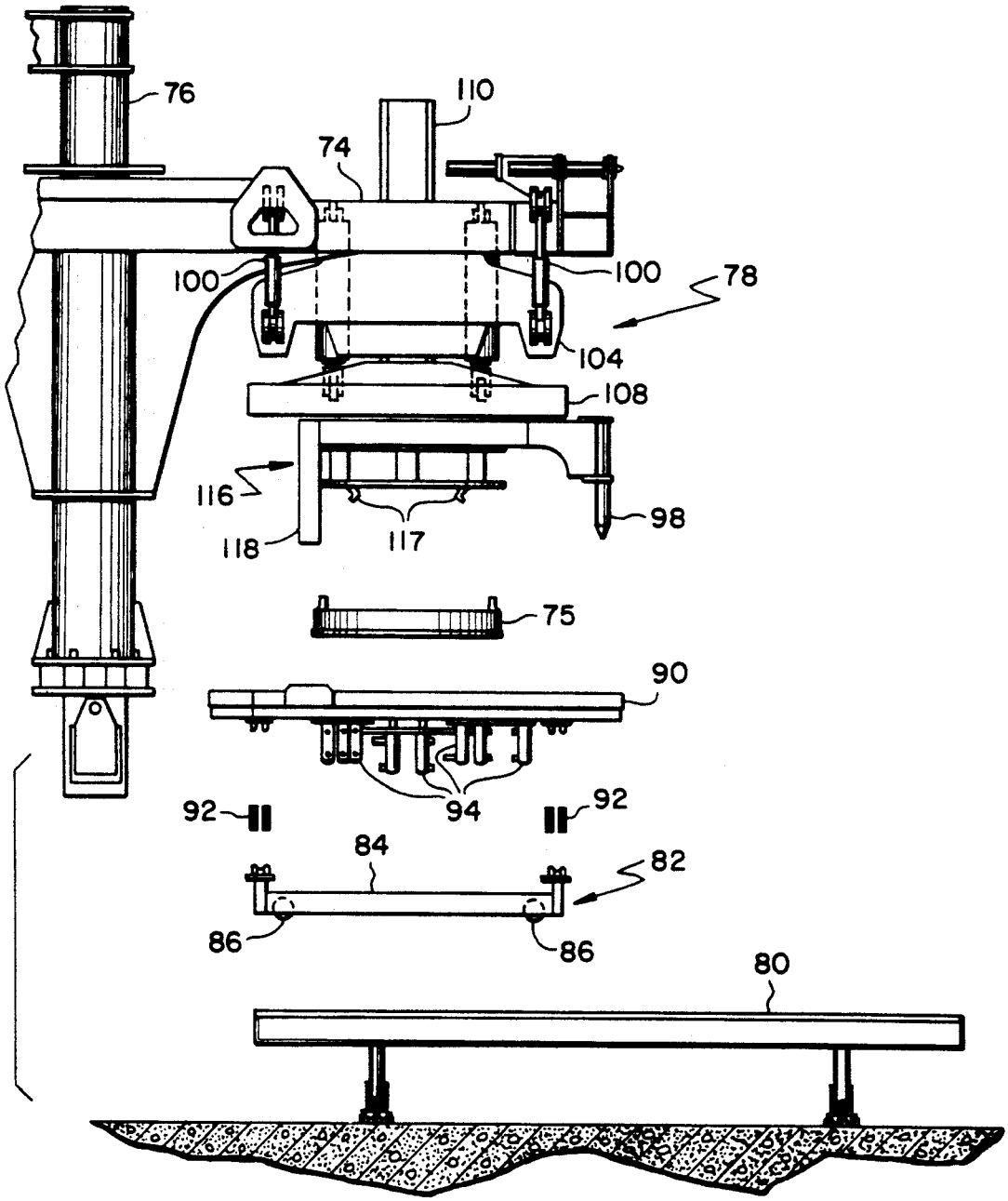
FIG. 9 is a side elevational view of the header cart shown positioned beneath the pressure head assembly.
Figure 10:
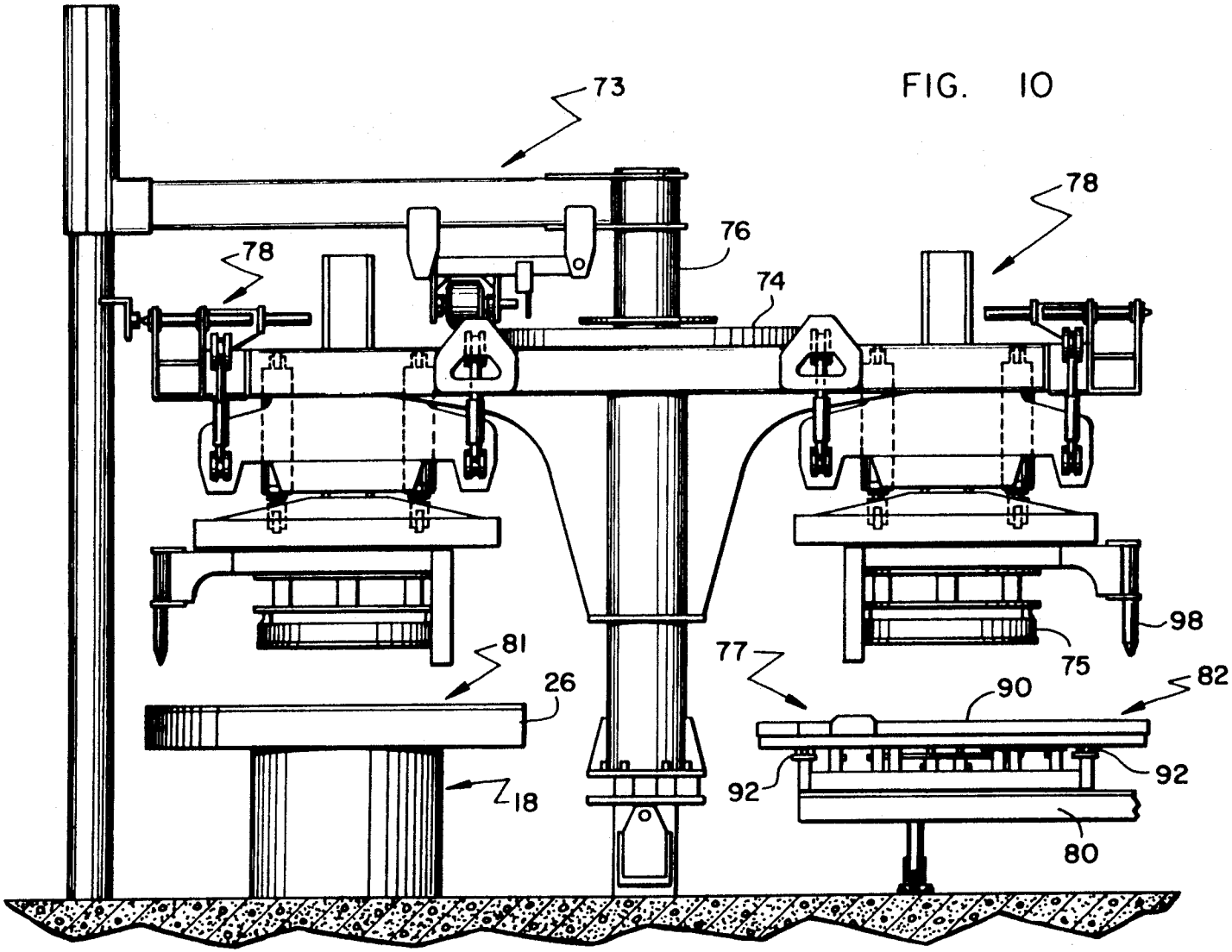
FIG. 10 is a side elevational view of the pressurehead carousel at the pressure head and header pick up stations.
Figure 11:
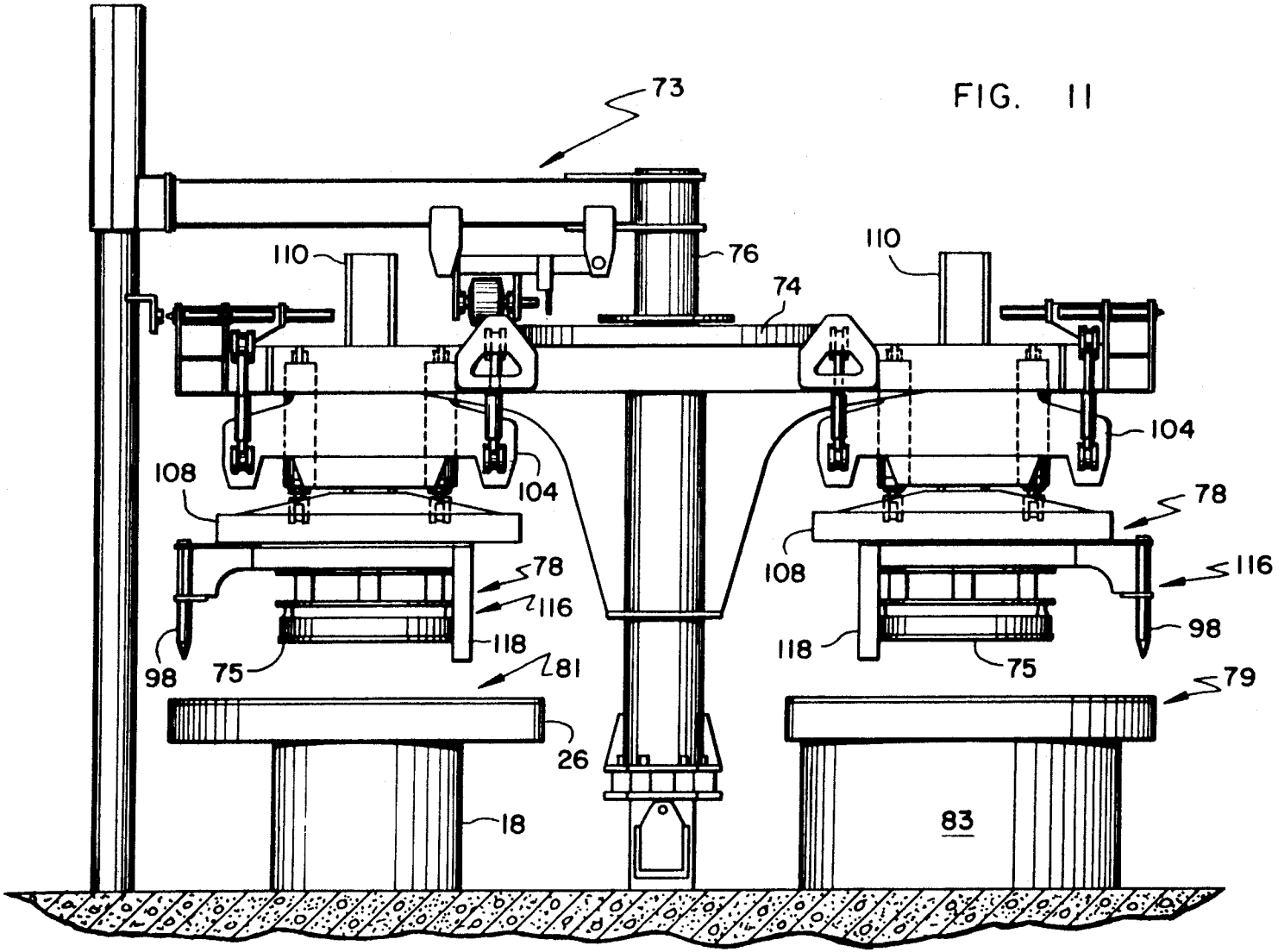
FIG. 11 is a side elevational view of the pressurehead carousel at the pressure head and oil dip stations.

After the cart 82 has been loaded with the appropriate number of headers 75 for the particular form set 18 that has been installed on the turntable 10, the cart 82 is advanced along rails 80 into a position beneath the pressureheading assembly 78. This is illustrated in FIG. 1 in which the header cart 82 is shown in broken lines. When the pressureheading assembly 78 is lowered over the cart 82 in the loading station 77, it will be in proper position for the clamping fixture 116 to pick up the header or headers 75 on the cart 82. FIGS. 9 and 10 illustrate a header 75 being picked up from the header cart 82 by a pressureheading assembly 78 on the carousel.

After a pressureheading assembly 78 has picked up a header 75 at the loading station 77, the carousel 73 will rotate and advance each assembly 78 to a different one of the stations. The assembly 78 carrying the header picked up at the loading station 77 will advance to the dipping station 79 where the header 75 is lowered into a tank 83 containing a concrete releasing agent by actuating cylinders 114. The next rotation of the carousel 73 will move the dipped header 75 into pressureheading station 22 for pressure-heading.

Figure 8:
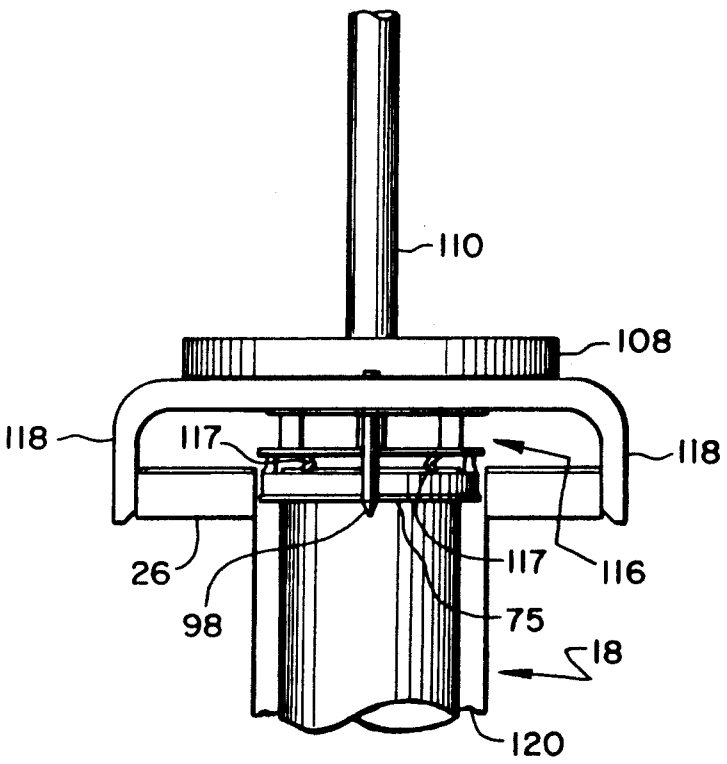
FIG. 8 is a side elevational view of a typical form top and pressure head clamping fixture with the fixture in the down position.
Figure 7:
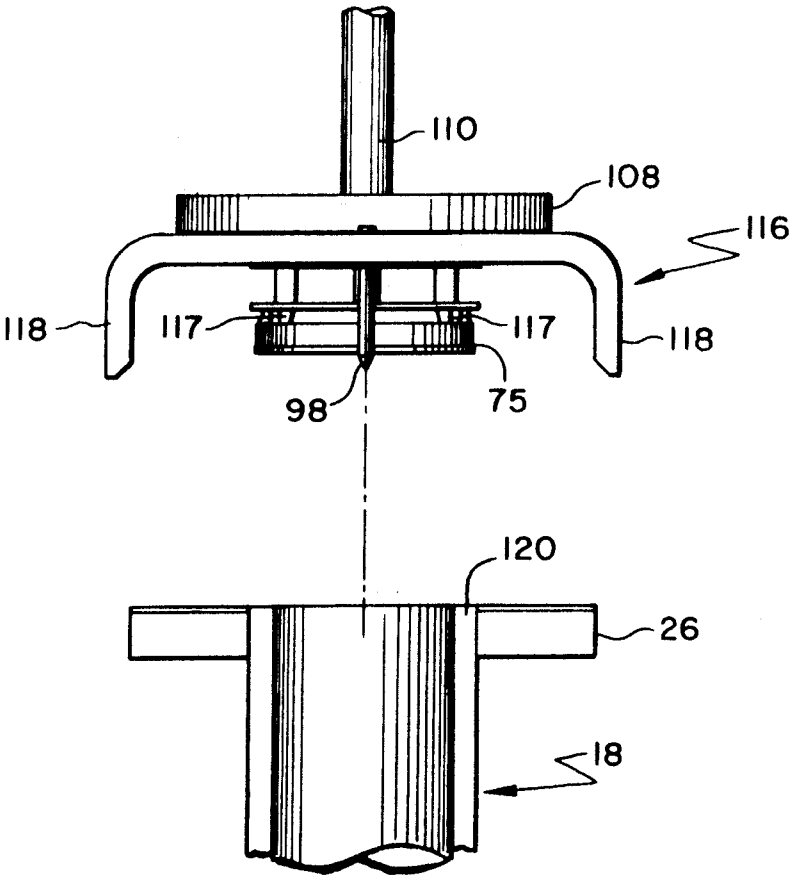
FIG. 7 is a side elevational view of a typical form top and pressure head fixture with the fixture in the up position.

FIGS. 7 and 8 illustrate how the "floating" construction of the pressureheading assembly 78 properly aligns the header 75 over a form set 18 to perform the pressureheading operation. FIG. 7 shows the clamping fixture 116 carrying a header 75 in position over a form set 18 and ready to be lowered. FIG. 8 shows the clamping fixture 116 lowered onto the form set 18 with the two side arms 118 and guide pin 98 positively guiding the header 75 into the cavity 120 of the form set 18 which was previously filled with concrete at the filling station 20. The two side arms 118 slide down over the edges of the top pan 26 while the alignment pin 98 enters a guide opening 122 (FIG. 1) in the top pan 26. After the header 75 is pressed into the cavity 120 the clamps 117 are released from the header 75 and the clamping fixture 116 is raised. It will be understood that by using the carousel 73, three different heading procedures are carried out at the three work stations (the loading station 77, the dipping station 79 and the pressureheading station 22) simultaneously at a single operating station of the machine, i.e., the pressureheading station 22.

The operations at the presssureheading station 22 are now completed, and the rotation of the turntable 10 will advance the now filled and pressure-headed form sets 18 to the stripping station 24 where the form jackets and pipe are removed from the machine in the customary, well-known manner. The now-formed pipe is stripped free of the jacket which is returned to the machine for the next filling cycle.

Because of the turntable arrangement and the automation provided by utilizing the principles of the invention, the three basic machine operations are telescoped into one time frame, thus maximizing efficiency and output. Also, the three-station carousel concept provides for performance of the different heading operations simultaneously. Use of the principles of the invention provides for operation of the pipe making machine in either an automatic or manual mode. In either mode, labor is reduced and efficiency improved.

Although the system of the invention has been described in connection with a preferred embodiment thereof, it will be evident to those skilled in the art that various revisions and modifications can be made to the preferred embodiment without departing from the spirit and scope of the invention. It is my intention, however, that all such revisions and modifications as are obvious to those skilled in the art will be included within the scope of the following claims.

What is claimed is as follows:

1. In an apparatus for producing concrete pipe using form sets containing at least one form cavity, the apparatus having a filling station, a pressurehead station, a stripping station and turntable means for supporting the form sets and moving them successively from station to station, the improvement comprising a carrier moveable from a retracted position forwardly to a filling position at the filling station, a feed tray carried by the carrier and having a forward end oriented toward the filling station, mounting means for securing the feed tray to the carrier so as to provide for limited movement of the feed tray in any direction relative to the carrier, the feed tray having a flat upper surface extended to its forward end, a feed pan supported by the feed tray on its upper surface for receiving concrete and distributing the concrete into the form cavities in the form set, power means providing for movement of the feed pan forwardly and rearwardly relative to the feed tray in a generally horizontal plane, first alignment means on the feed tray at its forward end, and second alignment means on the form set that is engageable with the first alignment means on the feed tray when the feed tray is advanced into the filling position, the first and second alignment means providing for alignment of the feed tray with the form set with the upper surface of the feed tray aligned with the upper surface of the form set.

2. In the apparatus of claim 1, in which the first alignment means includes a pair of alignment pins on the forward end of the feed tray, and the second alignment means includes a pair of alignment openings in the form set corresponding to the alignment pins so that when the guide pins are engaged in the alignment openings the upper surface of the feed tray will be aligned with the upper surface of the form set.

3. In the apparatus of claim 2, in which there is a clamping means that engages the feed tray and form set and locks them together in an aligned position.

4. In the apparatus of claim 3, in which the mounting means for securing the feed tray to the carrier includes a plurality of resilient means, a jib connection and a universal joint connection, all of which provide for limited movement of the feed tray relative to the carrier, thereby assuring proper alignment of the feed tray and form set.

5. In an apparatus for producing concrete pipe using form sets having an upper surface containing at least one form cavity extending downwardly from said upper surface, the apparatus having a filling station, a pressurehead station, a stripping station and turntable means for supporting the form sets and moving them successively from station to station, the improvement comprising a concrete carrier moveable from a retracted position to a filling position at the filling station, a feed tray carried by the carrier, mounting means for securing the feed tray to the carrier so as to provide for movement of the feed tray in any direction relative to the carrier, a feed pan supported by the feed tray and having an upper surface for receiving concrete and distributing the concrete into the form cavities in the form set, power means providing for forwardly and rearwardly movement of the feed pan relative to the feed tray, and first alignment means formed on the feed tray and second alignment means formed on the form set for aligning the feed tray with the form set with the upper surface of the feed tray aligned with the upper surface of the form set.

6. In the apparatus of claim 5, in which concrete distributing means is combined with the feed pan to distribute concrete carried by the feed pan into the form cavity.

7. In the apparatus of claim 6, in which the feed pan and concrete distributing means are moveable in a generally horizontal direction from the retracted position to the filling position.

8. In the apparatus of claim 7, in which the first alignment means for aligning the feed pan with the form set includes alignment pins and the second alignment means includes corresponding openings in the form set.

* * * * *